US009285463B1

(12) United States Patent
Freeman et al.

(10) Patent No.: US 9,285,463 B1
(45) Date of Patent: Mar. 15, 2016

(54) METHOD AND APPARATUS FOR BATTLE DAMAGE ASSESSMENT OF ELECTRIC OR ELECTRONIC DEVICES AND SYSTEMS

(71) Applicants: Stephen Dorn Freeman, Charleroi, PA (US); Walter John Keller, Bridgeville, PA (US)

(72) Inventors: Stephen Dorn Freeman, Charleroi, PA (US); Walter John Keller, Bridgeville, PA (US)

(73) Assignee: NOKOMIS, INC., Charleroi, PA (US)

( * ) Notice: Subject to any disclaimer, the term of this patent is extended or adjusted under 35 U.S.C. 154(b) by 443 days.

(21) Appl. No.: 13/712,031

(22) Filed: Dec. 12, 2012

Related U.S. Application Data

(60) Provisional application No. 61/630,421, filed on Dec. 12, 2011.

(51) Int. Cl.
*G01S 7/41* (2006.01)

(52) U.S. Cl.
CPC ..... *G01S 7/412* (2013.01)

(58) Field of Classification Search
CPC ..... G01S 7/412
USPC ..... 342/192, 90, 13–15
See application file for complete search history.

(56) References Cited

U.S. PATENT DOCUMENTS 4,726,224 A * 2/1988 D'Ausilio ..... 73/167
4,827,414 A * 5/1989 Christianson et al. ... 250/390.01
5,020,411 A * 6/1991 Rowan ..... 89/1.11
5,218,294 A 6/1993 Soiferman
5,227,800 A 7/1993 Huguenin et al.
5,302,830 A 4/1994 Shivanandan
5,424,633 A 6/1995 Soiferman
5,517,110 A 5/1996 Soiferman
5,537,909 A * 7/1996 Schneider et al. ..... 89/1.11
5,668,342 A 9/1997 Discher
5,714,888 A 2/1998 Naujoks
6,049,301 A 4/2000 Weagant
6,057,765 A 5/2000 Jones et al.
6,163,259 A 12/2000 Barsumian et al.
6,496,703 B1 12/2002 da Silva
6,720,905 B2 4/2004 Levitan et al.
6,759,863 B2 7/2004 Moore
6,765,527 B2 7/2004 Jablonski et al.
6,825,456 B2 11/2004 Chadwick et al.
6,897,777 B2 5/2005 Holmes et al.
6,927,579 B2 8/2005 Blades
6,985,771 B2 1/2006 Fischell et al.
7,046,187 B2 * 5/2006 Fullerton et al. ..... 342/54
7,130,624 B1 10/2006 Jackson et al.
7,138,936 B2 11/2006 Duff et al.
7,188,037 B2 3/2007 Hidehira (Continued)

FOREIGN PATENT DOCUMENTS

DE 102005040494 A1 * 3/2007

*Primary Examiner* — John B Sotomayor
(74) *Attorney, Agent, or Firm* — James Ray and Assocs

(57) ABSTRACT

A method for assessing results from application of energy onto one or more electric or electronic devices includes the steps of acquiring an electromagnetic emission from the one or more devices, directing energy onto the one or more devices, acquiring another electromagnetic emission from the one or more devices having the energy directed thereonto and determining, in accordance with at least one logic algorithm state and/or change in state of the one or more devices. There is also a microprocessor based apparatus that is employed for acquiring the electromagnetic emissions and executing the at least one logic algorithm. Energy is directed by either a weapon or electromagnetic phenomena.

54 Claims, 5 Drawing Sheets

(56) References Cited

U.S. PATENT DOCUMENTS

| | | | | |
|---|---|---|---|---|
| 7,391,356 | B2 | 6/2008 | Brumley et al. | |
| 7,427,947 | B1 * | 9/2008 | Dark et al. | 342/173 |
| 7,512,511 | B1 | 3/2009 | Schultz et al. | |
| 7,515,094 | B2 | 4/2009 | Keller, III | |
| 7,609,199 | B2 | 10/2009 | Nishijima et al. | |
| 7,639,178 | B1 | 12/2009 | Mulbrook et al. | |
| 7,645,982 | B1 * | 1/2010 | King | 250/252.1 |
| 7,777,671 | B2 | 8/2010 | Schnitzer et al. | |
| 7,777,672 | B2 | 8/2010 | Schnitzer et al. | |
| 7,844,341 | B2 | 11/2010 | Von Arx et al. | |
| 8,063,813 | B1 | 11/2011 | Keller | |
| 8,661,980 | B1 * | 3/2014 | Roemerman et al. | 102/489 |
| 2004/0218249 | A1 * | 11/2004 | Kochergin | 359/280 |
| 2006/0208672 | A1 * | 9/2006 | Achenbach et al. | 315/500 |
| 2007/0139247 | A1 * | 6/2007 | Brown et al. | 342/13 |
| 2007/0279071 | A1 | 12/2007 | Orton | |
| 2008/0103555 | A1 | 5/2008 | Dicks et al. | |
| 2008/0168895 | A1 * | 7/2008 | Duong | 89/1.1 |
| 2008/0206718 | A1 * | 8/2008 | Jaklitsch et al. | 434/12 |
| 2008/0297396 | A1 * | 12/2008 | Dark et al. | 342/14 |
| 2009/0078146 | A1 * | 3/2009 | Tepera et al. | 102/473 |
| 2009/0322585 | A1 * | 12/2009 | Galasso | 342/14 |
| 2010/0032557 | A1 * | 2/2010 | Schiller | 250/252.1 |
| 2010/0039340 | A1 * | 2/2010 | Brown | 343/756 |
| 2010/0123453 | A1 | 5/2010 | Pauly et al. | |
| 2010/0125438 | A1 | 5/2010 | Audet | |
| 2010/0171446 | A1 * | 7/2010 | Retsky | 315/379 |
| 2011/0235742 | A1 * | 9/2011 | London et al. | 375/295 |
| 2012/0223403 | A1 | 9/2012 | Keller, III et al. | |
| 2012/0226463 | A1 * | 9/2012 | Keller et al. | 702/117 |
| 2013/0050010 | A1 * | 2/2013 | Nordlander | 342/45 |
| 2013/0137066 | A1 * | 5/2013 | Pollak et al. | 434/14 |
| 2014/0313071 | A1 * | 10/2014 | McCorkle | 342/202 |

* cited by examiner

METHOD AND APPARATUS FOR BATTLE DAMAGE ASSESSMENT OF ELECTRIC OR ELECTRONIC DEVICES AND SYSTEMS

CROSS-REFERENCE TO RELATED APPLICATIONS

This application is related to and claims priority from U.S. Provisional Patent Application Ser. No. 61/630,421 filed on Dec. 12, 2011.

FIELD OF THE INVENTION

The present invention relates, in general, to battle damage assessment of electric or electronic devices and systems and, more particularly, this invention relates to a method and apparatus for assessing damage of an electric or electronic device or system after a weapon strike by comparing electromagnetic emissions before and after the strike and, yet more particularly, the instant invention relates to a method and apparatus for assessing results from application of energy onto one or more electric or electronic devices.

STATEMENT REGARDING FEDERALLY SPONSORED RESEARCH AND DEVELOPMENT

N/A

REFERENCE TO SEQUENCE LISTING, A TABLE, OR A COMPUTER PROGRAM LISTING COMPACT DISC APPENDIX

N/A

BACKGROUND OF THE INVENTION

As is generally well known, electric and electronic devices and systems are commonly used in modern warfare in a variety of applications. Generally, these devices and systems have been targeted by conventional munitions, such as rockets, bombs, artillery rounds and the like. Recently, non-conventional technologies such as High-Power Microwave (HPM) Directed Energy Weapons (DEWs), Radio-Frequency (RF) DEWs and High Energy Laser (HEL) DEWs have been effectively tested to strike electric or electronic devices or systems in mission scenarios, debilitating or disrupting critical functionality. HPM/RF DEWs are currently being developed for a host of novel applications to which conventional munitions are unsuited. However, the complex mechanisms by which DEWs induce damaging effects lend uncertainty into the extent of damage from a strike. Multipath, clutter and structural attenuation are often unpredictable and can limit the ultimate effect of the weapon.

Furthermore, the utility of the unmanned aerial systems (UAS), such as vehicles or drones, in combat has been proven by allied forces in Iraq, Afghanistan and other engagements around the world. The demonstrated ability of these vehicles to attack and provide Intelligence, Surveillance and Reconnaissance (ISR) has generated heightened interest within the United States Department of Defense (DoD). A 2009 report from the Brookings Institute, an industry survey identified six Iranian firms working on ten different UAS and eight Pakistani companies building some thirty different UAS. China exhibited more than twenty-five UAS at the Zhuhai Air Show in November, 2010. Indeed, use of UAS in combat has become a reality of modern and emerging warfare. Yet, to the best knowledge, Applicant is not aware of any capabilities to assess damage to UAS after a strike.

Therefore, there is a need for method and apparatus for assessing damage of an electric or electronic device or system after a strike by conventional weapons or DEWs.

SUMMARY OF THE INVENTION

In one embodiment, the invention provides a method for assessing results from application of energy onto one or more electric or electronic devices includes the steps of acquiring an electromagnetic emission from the one or more devices, directing energy onto the one or more devices, acquiring another electromagnetic emission from the one or more devices having the energy directed thereonto and determining, in accordance with at least one logic algorithm state and/or change in state of the one or more devices. Energy is directed by either a weapon or electromagnetic phenomena.

In another embodiment the invention provides a microprocessor based apparatus that is employed for acquiring the electromagnetic emissions and executing the at least one logic algorithm.

In yet another embodiment, the invention provides a battle damage assessment of electric or electronic devices or components thereof by a weapon.

OBJECTS OF THE INVENTION

It is, therefore, one of the primary objects of the present invention to provide a method for assessing damage of an electric or electronic device or system after a weapon strike.

Another object of the present invention is to provide a method for assessing damage of an electric or electronic device or system after a weapon strike by comparing electromagnetic emissions before and after the strike.

Yet another object of the present invention is to provide a method for assessing damage of an electric or electronic device or system after a weapon strike.

A further object of the present invention is to provide a method for assessing operating condition of an electric or electronic device or system before and/or after a weapon strike.

Yet a further object of the present invention is to provide a method of using reception of unintended electromagnetic emissions of electronics for the purpose of determining the operational state of an electronic system.

Still a further object of the present invention is to provide a method of using reception of unintended electromagnetic emissions of electronics for the purpose of determining the operational state of an electronic sub-system An additional object of the present invention is to provide a method for battle damage assessment of Directed Energy Weapons.

Another object of the present invention is to provide a method for battle damage assessment of Electromagnetic Pulse (EMP) weapons.

A further object of the present invention is to provide a method for Battle Damage Assessment of Conventional munitions.

Yet a further object of the present invention is to provide a method for battle damage assessment of a High Powered Microwave source.

Another object of the present invention is to provide a method of assessing damage of an electric or electronic device or system after a narrowband High Power Microwave Directed Energy Weapon event.

Yet another object of the present invention is to provide a method of assessing damage of an electric or electronic device or system after a wideband High Power Microwave Directed Energy Weapon event.

Yet another object of the present invention is to provide a method of assessing damage of an electric or electronic device or system after a High Power Laser Directed Energy Weapon event.

Yet another object of the present invention is to provide a method of assessing damage of an electric or electronic device or system after a Kinetic Weapon event.

Yet another object of the present invention is to provide a method of assessing damage of an electric or electronic device or system after an ultra-wideband High Power Microwave Directed Energy Weapon event.

Yet another object of the present invention is to provide a method of assessing damage of an electric or electronic device or system after a Nuclear Electromagnetic Pulse (EMP) event.

Still a further object of the present invention is to provide a method for battle damage assessment of a radio-frequency source.

Another object of the present invention is to provide a method of assessing damage of an electric or electronic device or system after a weapon strike with an apparatus mounted on an Airborne Platform.

Yet another object of the present invention is to provide a method of assessing damage of an electric or electronic device or system after a weapon strike with an apparatus mounted on a Sea-borne Platform.

Still another object of the present invention is to provide a method of assessing damage of an electric or electronic device or system after a weapon strike with an apparatus mounted on an a ground-based Platform.

A further object of the present invention is to provide a method of assessing damage of an electric or electronic device or system after a weapon strike when electric or electronic device or system is co-located with the apparatus configured to receive and process electromagnetic emissions.

Yet a further object of the present invention is to provide a method of assessing damage of an electric or electronic device or system after a weapon strike when electric or electronic device or system is disposed remotely from the apparatus configured to receive and process electromagnetic emissions.

Still a further object of the present invention is to provide a method of assessing extent of damage to an electric or electronic device or system located within a structure after a weapon strike.

Another object of the present invention is to provide an apparatus configured for use in assessing damage of an electric or electronic device or system after a weapon strike and including an antenna, ultra-low noise figure Low Noise Amplifier, an ultrasensitive receiver, a computationally intensive means to undertake signal processing, a computer architecture to algorithmically assess the data collected against know metrics of damage for the detection of unintended emissions of the target for battle damage assessment.

Yet another object of the present invention is to provide an apparatus configured for use in assessing damage of an electric or electronic device or system after a weapon strike and including an antenna, ultra-low noise figure Low Noise Amplifier (LNA), an ultrasensitive receiver, a computationally intensive means to undertake signal processing, a computer architecture to algorithmically assess the data collected against know metrics of damage for the detection of unintended emissions of the target for battle damage assessment and wherein a switch or filter is inserted in-line between the antenna and LNA to block energy from the DE source from damaging the low noise figure LNA.

Still another object of the present invention is to provide an apparatus configured for use in assessing damage of an electric or electronic device or system after a weapon strike and is further configured to take a before and after snapshot of the device or system where the before snapshot is automatically stored in a storage mechanism and then compared to the after snapshot to identify changes in the target device or system.

A further object of the present invention is to provide an apparatus configured for use in assessing damage of an electric or electronic device or system after a weapon strike and is further configured to take a before snapshot and compare it to a known signature to assess if the device or system is a correct target.

Yet a further object of the present invention is to provide an apparatus configured for use in assessing damage of an electric or electronic device or system after a weapon strike and is further configured to take an after snapshot and compare it to a known signature to assess if the device or system is a correct target.

A further object of the present invention is to provide an apparatus configured for use in assessing damage of an electric or electronic device or system after a weapon strike and is further configured to take a before and after snapshot and compare the before and after snapshot to one another as well as to anticipated signatures to determine if the device or system is the correct target and also to determine if required level of damage has been achieved.

Yet a further object of the present invention is to provide an apparatus configured for use in assessing damage of an electric or electronic device or system after a weapon strike and is further configured to take multiple collections such that there is a series of measurements before, after and between multiple directed energy events with the assessment being made between each successive event.

Still a further object of the present invention is to provide an apparatus configured for use in assessing damage of an electric or electronic device or system after a weapon wherein the apparatus is installed in at least one of missile, cruise missile, intercepter, aircraft, spacecraft, ground vehicle, unmanned aerial vehicle, stationary ground based facility, a ship, a submarine or any other sea based platform.

Another object of the present invention is to provide an apparatus configured for use in assessing damage of an electric or electronic device or system after a weapon strike and is further configured to execute several algorithms in parallel to assess different aspects of the damage to provide enhanced battle damage assessment.

Yet another object of the present invention is to provide an apparatus configured for use in assessing damage of an electric or electronic device or system after a weapon strike even where any battle damage indicators are provided even if a full battle damage assessment may not be possible.

Still another object of the present invention is to provide an apparatus configured to measure electromagnetic emission apparatus is mobile and monitors electrical or electronic manufacturing equipment that is targeted by directed energy.

A further object of the present invention is to provide an apparatus configured to measure electromagnetic emission and is further configured as a permanently fixed device to monitor specific electrical or electronic manufacturing equipment.

Yet a further object of the present invention is to provide an apparatus configured to measure electromagnetic emission and is further configured for use in quality assessment related to directed energy effects of products targeted in a manufacturing facility.

Still a further object of the present invention is to provide an apparatus configured to measure electromagnetic emission and is further configured for assessment of the quality of materials to be incorporated into a manufactured product after a directed energy event.

Another object of the present invention is to provide an apparatus configured to measure electromagnetic emission and is further configured to assure that all subcomponents and subassemblies are correctly or not correctly functioning.

Yet another object of the present invention is to provide an apparatus configured to measure electromagnetic emission and is further configured to assure that all subcomponents and subassemblies in a target have degraded.

Still a further object of the present invention is to provide an apparatus configured to measure electromagnetic emission and is further configured to identify targets in a facility susceptible to future events.

Another object of the present invention is to provide a method of assessing damage of an electric or electronic device or system after a narrowband High Power Microwave Directed Energy Weapon event.

Yet another object of the present invention is to provide a method of assessing damage of an electric or electronic device or system after a wideband High Power Microwave Directed Energy Weapon event.

Yet another object of the present invention is to provide a method of assessing damage of an electric or electronic device or system after a High Power Laser Directed Energy Weapon event.

Yet another object of the present invention is to provide a method of assessing damage of an electric or electronic device or system after a Kinetic Weapon event.

Yet another object of the present invention is to provide a method of assessing damage of an electric or electronic device or system after an ultra-wideband High Power Microwave Directed Energy Weapon event.

Yet another object of the present invention is to provide a method of assessing damage of an electric or electronic device or system after a Nuclear Electromagnetic Pulse (EMP) event.

A further object of the present invention is to provide a method for assessing results from exposing one or more electric or electronic devices to electromagnetic phenomena.

Yet a further object of the present invention is to provide a method for assessing results from exposing one or more electric or electronic devices to at least one of lightning strike, cosmic ray event, and solar flare.

Still a further object of the present invention is to provide a method for assessing results from exposing one or more electric or electronic devices to power surges.

Another object of the present invention is to provide a method and apparatus for detecting counterfeit electronics.

In addition to the several objects and advantages of the present invention which have been described with some degree of specificity above, various other objects and advantages of the invention will become more readily apparent to those persons who are skilled in the relevant art, particularly, when such description is taken in conjunction with the attached drawing Figures and with the appended claims.

BRIEF DESCRIPTION OF THE VARIOUS EMBODIMENTS OF THE INVENTION

Figure 1:
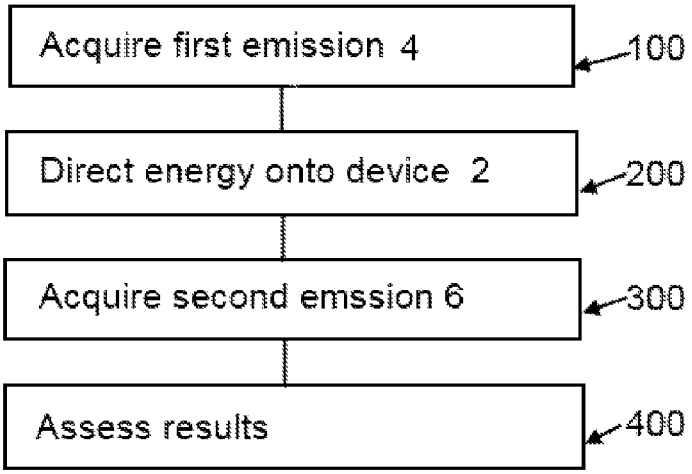
FIG. 1 is a flowchart of a method for assessing results from application of energy onto one or more electric or electronic devices in accordance with one embodiment of the invention.

Prior to proceeding to the more detailed description of the present invention, it should be noted that, for the sake of clarity and understanding, identical components which have identical functions have been identified with identical reference numerals throughout the several views illustrated in the drawing figures.

Now in a particular reference to FIG. 1 and in accordance with one embodiment of the invention, therein is provided a method for assessing results from application of energy onto one or more electric or electronic devices or targets 2. In one embodiment, the method comprises the step 100 of acquiring a first electromagnetic emission 4 of the one or more devices 2. For the reasons to be explained later, the step 100 is not an essential step, particularly when such first electromagnetic emission 4 is an intended emission. At step 200, the energy is directed onto said one or more devices 2. Such energy may be directed in a number of different applications. In one form, the one or more devices 2 may be exposed, intentionally or unintentionally to electromagnetic phenomena 7, including but not limited to lightning strike, cosmic ray event, and solar flare. In another form, the one or more devices 2 may be exposed, intentionally or unintentionally, to power surges common in electrically operable devices 2. In yet another form, the energy may be directed by way of striking the one or more devices 2 with a weapon 8 or striking a building, enclosure or facility containing such one or more devices 2. In all embodiments, the energy is directed onto one or more devices 2 from a distance thereto and in absence of physical and/or electrical connection.

At step 300, the method contemplates acquiring another or second electromagnetic emission 6 from the one or more devices 2 having the energy directed thereonto.

Finally, at step 400, determination and/or assessment of results from application of the energy onto the one or more devices 2 is carried out in accordance with at least one logic algorithm, results. More particularly, step 400 is related to determination and/or assessment of state and/or change in state of the one or more devices 2. In step 400 of one form, electromagnetic emission 6 acquired in step 300 is compared against a previously acquired electromagnetic emission 4 in step 100 from the one or more devices 2 prior to the energy directed thereonto in step 200. Step 400 further includes the step of assessing, in accordance with at least one logic algorithm, differences between the electromagnetic emission 6 acquired in step 300 and the previously acquired electromagnetic emission 4. Based on the assessment, step 400 includes the step of determining an essentially complete destruction or degradation of the one or more devices 2 in full absence of the second electromagnetic emission 6; or the step 400 includes the step of determining a destruction or degradation of a sub-component of the one or more devices 2 or a partial destruction or degradation of the one or more devices 2 in absence of a component of the second electromagnetic emission 6; or the step 400 includes the step of determining a disruption in operation of the one or more devices in presence of at least one difference in the first and second electromagnetic emissions, 4 and 6 respectively. In either determination, the step 400 includes the step of executing at least one measurement. Based on the measurements and results determined in step 400, the method further comprises the step of identifying one or more devices 2 susceptible to additional directed energy events. By way of one example, a computer that rebooted after application of directed energy in step 300, as determined either by change in state of electromagnetic emissions 4 or entirely new electromagnetic emissions 6 that were not present prior to application of the directed energy, would be susceptible to other applications of the directed energy and the state of the computer after the reboot may be further predicted based on known or learned patterns for computers of this particular class.

It has been found that target class analysis and algorithm development are important to provide the generalized detection and identification of one or more devices 2, thus the method may also include an optional step of determining and/or defining classes of the one or more devices 2 and determining and/or defining the number of devices 2 within a specific class. The method also includes the step of determining a selection of electromagnetic emission signatures which are associated with one or more devices 2 that span the variability of a specific target class.

Preferably, the method is further based on the taxonomy of the target class. The taxonomic breakdown of the target class, preferably, includes makes, models, subcomponents, and board-level devices. An analysis of the results of the investigation allows to determine the variability and ubiquity of components within the class and select a breadth of target models which spans this variability.

The above described method also includes the step of detecting electronics' functional state and changes due to directed energy engagements in real-time and the step of collecting and analyzing key spectral slices within the Electro-Magnetic Environment (EME) with high resolution and minimal latency.

Figure 3:
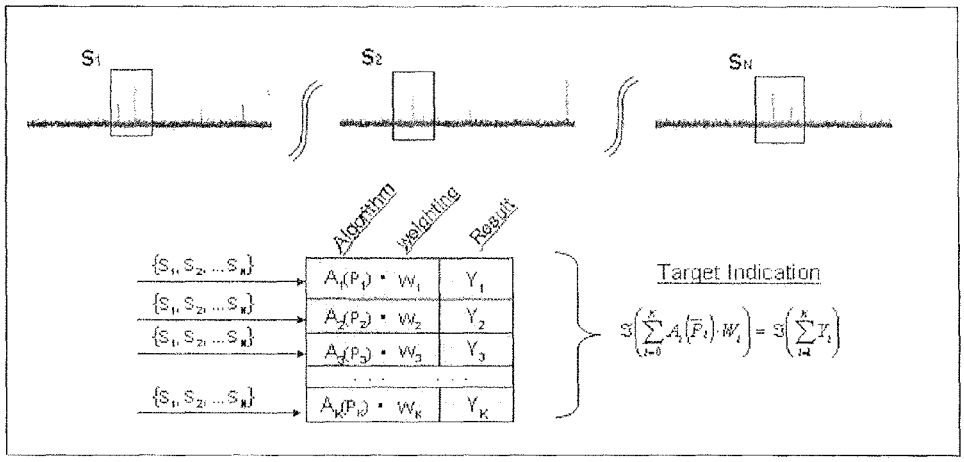
FIG. 3 is a block diagram of one step employed within the method of FIG. 1.

Furthermore, in reference to FIG. 3, the step 400 provides for the at least one logic algorithm being a plurality of logic algorithms and further includes the step of weighting the plurality of logic algorithms used on the backend to detect and assess the state and/or change in state of the electric or electronic devices or targets 2 of interest.

System targeting uses a signature data file which contains relevant parameters required for the detection of a given electronic device 2. As shown in FIG. 3, in order to declare state, change in state or operating condition of the one or more devices or target 2, parameters critical to signature matching are extracted from specific spectral slices $\{S_1, S_2 \ldots S_N\}$ indicated by the target's signature file, containing all necessary parameters. Next, these parameters are passed through several algorithms initialized with parameters $\{P_1, P_2 \ldots P_K\}$ relevant to the specific electronic device to derive multiple orthogonal indicators of target presence. The resultant output of each algorithm is then weighted $\{W_1, W_2 \ldots W_K\}$ based on the signature characteristics and combined to form a score which is assessed via a probability distribution, F(x), to ultimately declare, for example by displaying target status as "nominal", "detected", "verified", "changed", "degraded", "damaged" or "non-operational" and internally a figure of merit for the extent of operational degradation is calculated. This breadth of indicators and specificity in algorithm parameters used for detection is instrumental in reducing the false-positives and the modular design provides an easy and rapid platform to install updates.

The method is not limited to only a single application of directed energy and contemplates the step of additional events of directing energy onto the one or more devices 2 and the step of executing the at least one measurement before, after and between the additional events.

Figure 2:
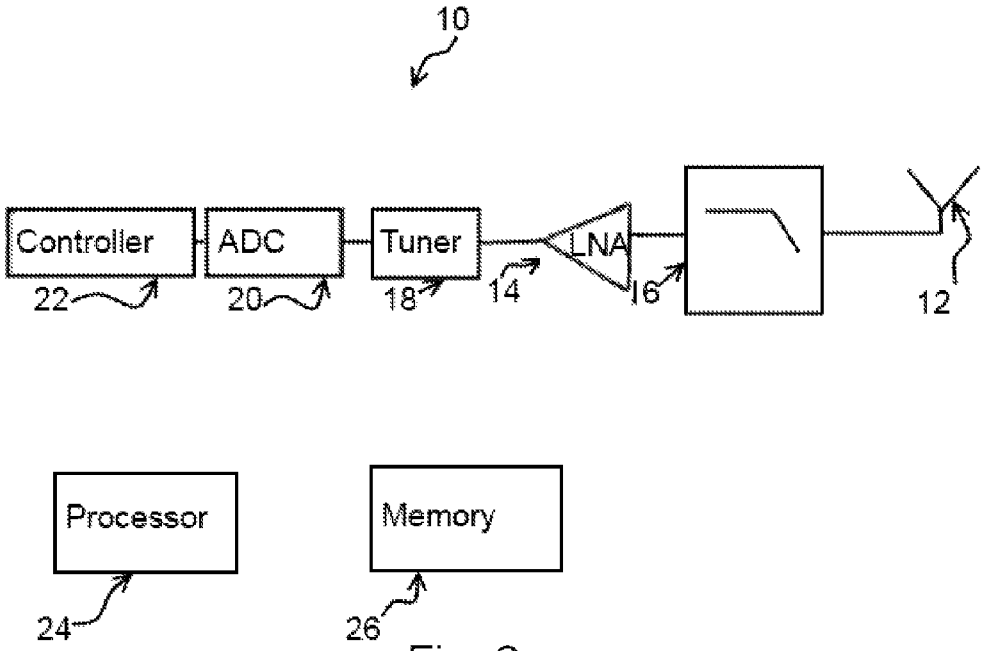
FIG. 2 is a block diagram of an apparatus employed within the method of FIG. 1.

The above described method is generally practiced by providing an apparatus, generally designated as 10, best shown in FIG. 2 and comprising an antenna 12, amplifier 14, a filter 16 disposed between and coupled to the antenna 12 and the amplifier 14, a tuner 18, an analog to digital converter 20, and, preferably, a controller 22 having a processor 24, configured to execute one or more logic algorithms and a memory 26. The filter 16 is configured to block energy from the energy source from damaging the amplifier 14.

In one form, the apparatus 10 is employed to only acquire one of the first and second emissions, 4 and 6 respectively. In the another form, the apparatus 10 is employed to not only acquire both the first and second emissions, 4 and 6 respectively, but also to execute one or more logic algorithms so as to determine state, change in state or operating condition of one or more devices 2. In yet another form, the apparatus 10 is employed to acquire the second emission 6 after the application of directed energy with the first emission 4 being known before the strike and either being stored in a memory 26 of the apparatus 10 or is being stored in a remote location.

The apparatus 10 is configured, both in hardware and software, to detect the presence of any given number of electronic devices 2 from stand-off distances and report health, state, change in state or operating condition of these devices 2 after application of directed energy.

Furthermore, software-based logic algorithms are configured to detect and identify devices 2 from ground, seaborne and airborne platforms at low Signal-to-Noise Ratios (SNRs) and within acceptable confidence and false positive detection limits.

More specifically, the apparatus 10 is configured to detect and identify specific electronic devices 2 through the use of a priori information stored in a library of device signatures contained within the memory 26. Since Battle Damage Assessment (BDA) of direct energy weapons (DEW) 8 often requires the detection and identification of any electronic device 2 within a specific class of interest, this capability has been extended to class detection.

The apparatus 10 employs ultra-sensitive RF and microwave sensing to determine if a target, such as one or more devices 2, has been impacted by Directed Energy. The method is based on the analysis of target-class RF phenomenology, development of algorithms for class detection which leverage the techniques developed, and testing to demonstrate the developed detection and identification performance.

Figure 4:
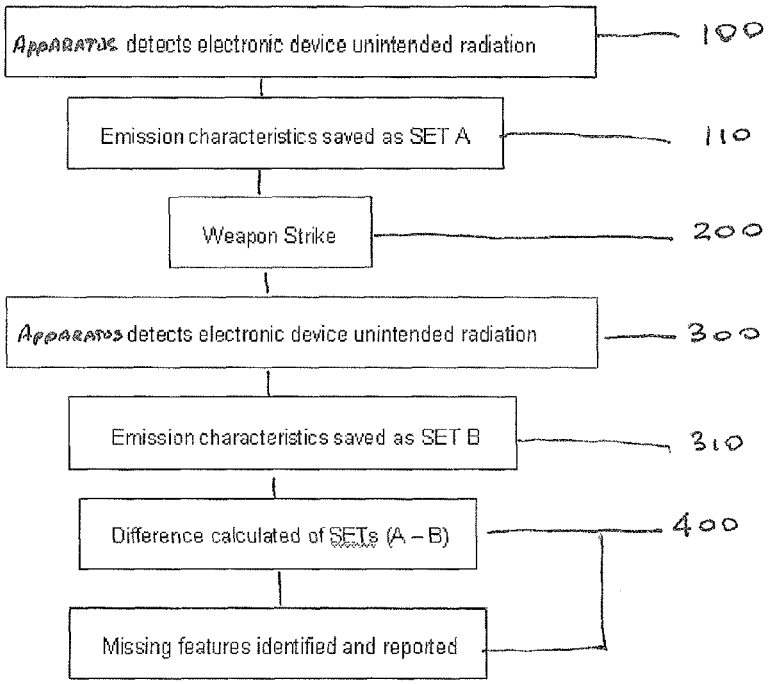
FIG. 4 is a flowchart of a method for assessing results from application of energy onto one or more electric or electronic devices in accordance with another embodiment of the invention.
Figure 5:
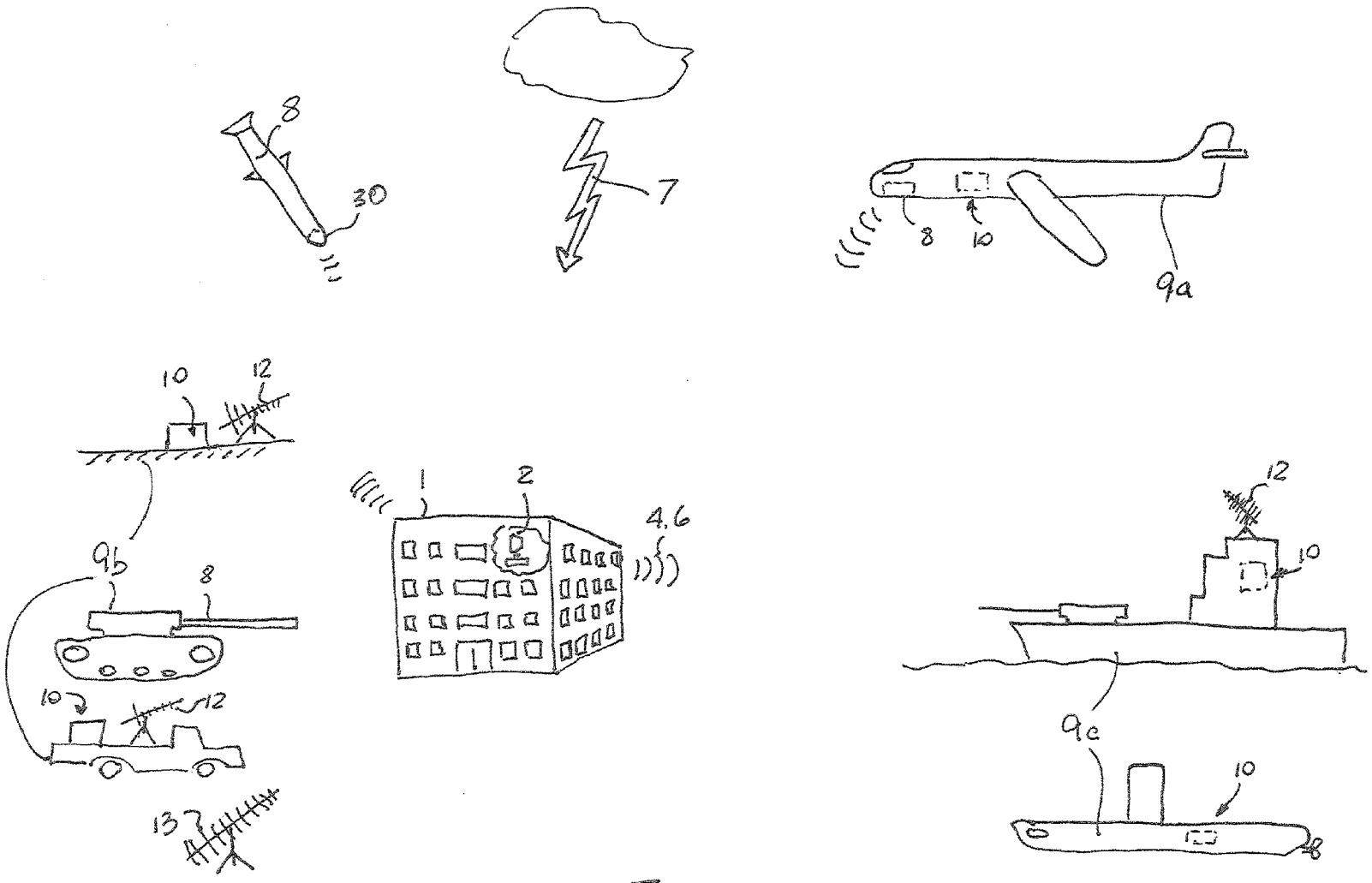
FIG. 5 is an environmental view of the method of FIGS. 1 and 4.

In another embodiment of FIG. 4, the method includes the above described step 100 though 400, except that step 200 provides for applying directed energy by way of striking one or more devices 2 with a weapon 8. Furthermore, FIG. 4 illustrates that each emission characteristic is saved within memory 26 in steps 110 and 310.

The weapon 8 may be provided as at least one of narrowband, wideband and ultra-wideband high powered microwave (HPM) weapon, a high energy laser (HEL) weapon, a kinetic weapon, an electromagnetic pulse weapon, and conventional munitions such as missile, artillery ordinance, grenade, bomb and explosive device.

The above described apparatus 10 is also employed here, preferably for acquiring both the first electromagnetic emission 4 and the second electromagnetic emission 6. In general, the apparatus 10 is contemplated to be installed on at least one of an airborne platform 9*a*, a ground borne platform 9*b* and a seaborne platform 9*c*. Thus, the method further comprises the step of installing the above described apparatus 10 on or in the weapon 8 being at least one of an airborne platform 9*a* including but not limited to missile, cruise missile, interceptor, aircraft, spacecraft, unmanned aerial vehicle, ground borne platform 9*b* such as a vehicle, stationary ground based facility, and a seaborne platform 9*c* such as for example a marine craft, a submarine, or a stationary structure.

The method further includes the step of stimulating and/or illuminating the one or more devices 2 with a source 30. The source 30 may be at least one of a high powered microwave source, a radio-frequency source, and a high energy laser source.

Such source 30 may be the above described weapon 8 or the source 30 may be installed on, in close proximity to or be integrated as part of the weapon 8.

When the first emission 4 is available to be identified in sufficient time span prior to the weapon strike, the apparatus 10 may be employed to collect signature elements of such first emission 4 so as to determine benchmark point-to-point free-space detection distances, false positives, and confidence of detection metrics and/or logic algorithms employed in step 400.

Since individual devices or targets 2 have varied radiated emission signature power-levels and, depending on emplacement, these radiated signatures may experience significant attenuation prior to reception, the apparatus 10 is adapted with means to select optimal sensitivity settings based on prior knowledge of the target, empirical date or benchmarks.

It has been found that sensitivity of the apparatus 10 to radio frequency (RF) radiation for detection purposes is subjected to sensor saturation and/or damage from DEW reflections during a weapon strike. It has been further found when monitoring a facility or location 1 containing such one or more devices or targets 2, even from a considerable standoff range, DEW antenna side lobes, reflections or fuse mis-timing may deliver excess energy towards the apparatus 10. Thus, the apparatus 10 has been configured so as to electrically isolate the front-end of the apparatus 10 in the presence of high power events.

Accordingly, in one embodiment, apparatus 10 incorporates four (or more) separate detection channels within a forced-air convection-cooled chassis designed for harsh environments. Each channel is configured to independently collects the data and undertake signal processing on the available data streams. Thus, in a further embodiment, apparatus 10 is configured to meet MIL-STD-461 and MIL-STD-810, is environmentally sealed, and is specifically designed to operate on DC military vehicle power standards at about 200 Watts.

The above described method steps and employment and configuration of the apparatus 10 are specifically advantageous for the automated detection and verification of electronics. Automation is a key characteristic to a tactically useful system and represents core strength of the apparatus 10. The user interface (not shown) of the apparatus 10 is configured so that any non-technical operator can easily and safely operate the apparatus 10 and interpret the output target indications.

The ability of the invention to detect weak emitters relies in part on optimizing the sensitivity of the apparatus 10 around the electromagnetic emission signature to be acquired and processed. Sensitivity may be directly enhanced through processing large quantities of data. This approach to increased sensitivity is directly applicable to electronics detection in which electromagnetic emission signature elements are typically narrowband.

Figure 6:
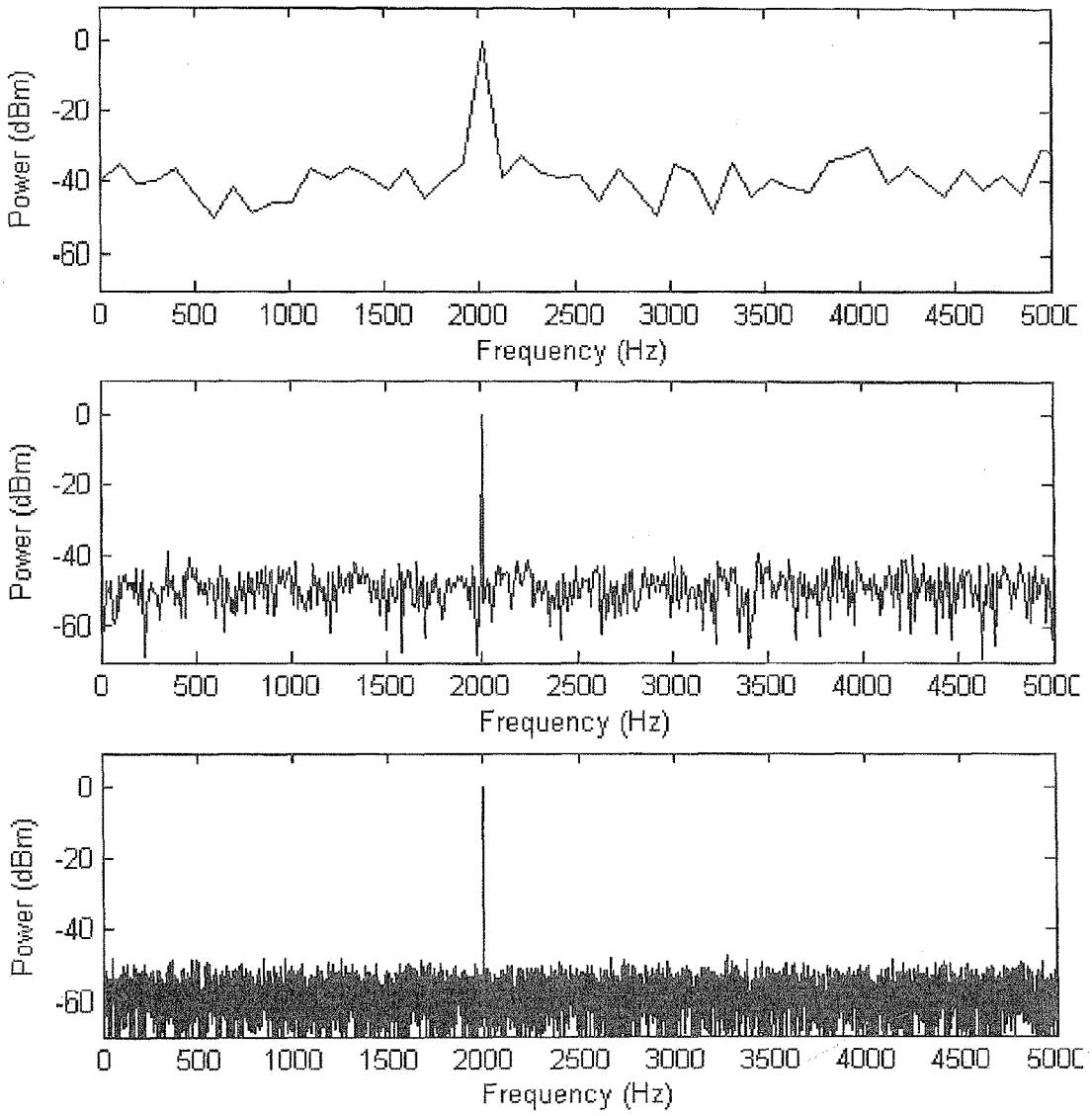
FIG. 6 illustrates effects of quantity of processed information on quality of the received emission signal.

As seen in FIG. 6, an increase by three orders of magnitude in the quantity of processed information directly improves the Signal to Noise Ratio (SNR) of the received signal by 30 dB. Sensitivities of this magnitude are particularly important to BDA systems which must detect weak emitters in the presence of significant attenuating effects. When both the apparatus 10 and transmitting device 2 are emplaced within a few wavelengths of earth, near-ground effects easily cause 25 dB/decade or even 30 dB/decade path loss, rather than the free-space model loss of 20 dB/decade indicated by the Friis Transmission Equation. Processing increased data lengths provides detection algorithms additional information to dissociate transient environmental interference from electromagnetic emission signatures of one or more devices 2. It is therefore critical for the apparatus 10 to be configured and operate with sensitivity levels in excess of minimum requirements in order to ensure detection for all devices 2 of interest.

Figure 7:
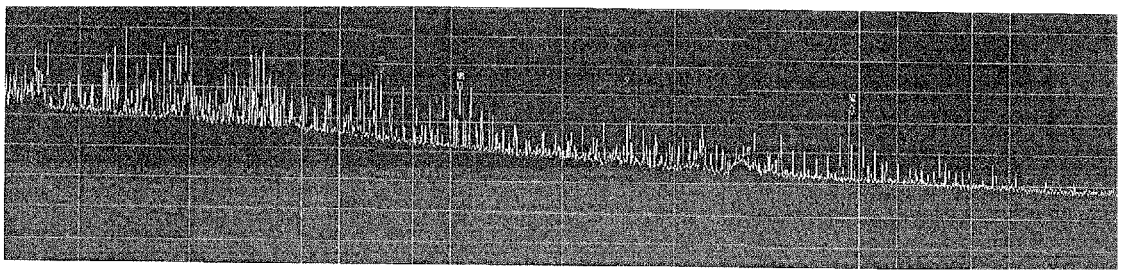
FIG. 7 illustrates an example of an unintended emission frequency from a desktop computer.

The use of apparatus 10, which receives and processes either intentional or unintentional radiation from electronic devices 2, represents a viable avenue to provide a BDA capability for HPM/RF Directed Energy Weapons or for that manner any event that causes intended or unintended degradation of electronics. All electronic devices necessarily emit electromagnetic radiation either intentionally during operation or unintentionally from internal clocks, processors and active circuitry. An example of unintended emission is shown in FIG. 7. This electromagnetic radiation is characteristic to the specific device 2 and, apparatus 10 exploits signature elements of such electromagnetic radiation to indicate the presence of the device 2 from stand-off range, preferably greater than 1 kilometer (km). The at least one algorithm is preferably a plurality of algorithms including but not limited to the real-time processing of high-resolution spectral data, automated detection and identification of device 2 electromagnetic emission signature elements, and noise and interferer mitigation.

Efforts have demonstrated the ability to identify modifications to electronic circuits through remote analysis of unintended emissions. Induced RF effect on device's unintended emissions have been analyzed to optimize DEW waveforms and assess the outcome of the waveforms. Moreover, the development of low-power directed energy sources to suppress electronic device functionality, an effect which is verified through the analysis of the device's unintentional emissions was completed during development of this invention. Together, this work provided a body of work and experience which are fundamental to this invention.

When the first emission 4 is known in advance of a weapon strike when at least one device 2 in the target location is known, the method provides for testing such device 2 in a suitable environment, for example such as an anechoic chamber, measuring emissions and distilling relevant signature information and parameters from measurements for further use by the apparatus 10 in processing the second emission 6 after the weapon strike. More specifically, the distilled electromagnetic emission signature information and parameters can be stored in the memory 26 for baseline purposes and used in optimizing logic algorithms particularly related to spectral resolution for individual signature elements. Furthermore, distilled electromagnetic emission signature information and parameters are employed for selecting a preferred configuration of the antenna 12. Thus, as it has been described above, it is not essential to practice step 100 with the apparatus 10 immediately before the DEW strike or other application of directed energy.

The method also contemplates the step of using fragility (levels of energy required to cause damage in electronic circuits) data on the devices or targets 2 in conjunction with electromagnetic emission signature analysis to identify the key emissions of subcomponents of the devices 2 more prone to failure during DEW strikes or other application of directed energy. Electromagnetic emission signature elements associated with components prone to failure may be further weighted for analysis either identically or more heavily than other components to improve the system's optimization for the target device 2 of interest.

As was stated above, the above described method applies to HPM DEWs, High Energy Laser (HEL) DEWs and conventional munitions strikes on electric or electronic targets. For HEL DEW strikes it has been found that the considerable heating on device or target 2 causes a shift in frequency of the emission components of the targeted electronics due to the considerable influence of temperature on electronic operation. HEL DEWs are also capable of complete disablement of electronics. The absence of the electromagnetic emissions from the device 2 after illumination by a laser can be interpreted for a battle damage assessment indication.

These techniques of assessing the passive electromagnetic emissions of electronics at range or distance can be employed for conventional battle damage assessment. Conventional weapons, applied against devices or targets 2 which either contain electronics or are themselves electronic in nature, are typically verified for battle damage through visual inspection (satellite imagery or cameras embedded in the weapon). However, the instant invention contemplates that this approach to BDA is not capable of providing information regarding the operational state of electronics within the target. Therefore, the passive spectrum emanating from the target device 2 is preferably assessed before, during and after the weapon strike.

The instant invention also contemplates Radio Frequency illumination of the target 2 to enhance the ability of a passive receiver to detect damage to the target device 2. This concept for detecting electronics is described in U.S. Pat. No. 7,515,094 B2, owned by the assignee of the instant invention. Teachings of U.S. Pat. No. 7,515,094 B2 are incorporated herein by reference thereto. When the weapon itself is electromagnetic in nature, for example such as High Powered Microwave, this energy may be used as a surrogate for the active illumination described in U.S. Pat. No. 7,515,094 B2. In other cases, a separate illumination source 30 provides increased information content about the targeted electronics before and after the weapon strike.

HEL DEW systems, in accordance with the instant invention, have been shown effective in testing activities for engaging Unmanned Aerial Systems (UAS). These weapon systems are capable of inducing graduated effects upon UAS components, including payload sensors, downlinks and avionics at operational range. However, in order to realize the full potential of these engagements, a mechanism to remotely diagnose the extent of damage from a strike is required. A real-time BDA capability provides, further coupled with geolocation of the target devices 2 to be described later in this document, not only the required verification of a weapon strike to combat commanders, but also an opportunity to intelligently optimize the weapon system performance by providing a mechanism to effectively disengage the targeted UAS subsystem once the required effect level is achieved. This added capability, in turn, reduces the required time-on-target for HEL DEW systems and improves weapon performance in multi-target engagement scenarios.

Threat UAS systems include advanced electronics, which are considered prime targets for acquisition and identification through the sensitive RF reception and analysis. Thus, the invention contemplates that the techniques described in this document may be applied to HEL DEW engagement of UAS subsystems to provide a real-time BDA capability.

Characterization of devices 2, for example such as above described UAS is critical to use of at least one logic algorithm in step 400 and entails measuring passive electromagnetic emissions from the device 2 so as to develop an understanding of their character, behavior and mutual association within the emission spectrum. Further, characterization requires the system or subsystem to be measured and assessed in each potential operational state to correlate electromagnetic emission spectrums and functionality (e.g. emissions of an actively slewing EO/IR sensor as compared to the emissions of the same sensor positioned statically). Instant invention contemplates characterization of each of the procured UAS and any other systems or subsystems within an anechoic chamber, in the laboratory setting, on the test range or in an operational field environment.

Instant invention also contemplates that the above described method is suitable for detecting and identifying type or class of one or more devices 2, determining geographical location of one or more devices 2, and correlating path of the directed energy onto one or more device 2 in accordance with the determined real-world geographical location.

The specific embodiments of geo-locating source of emissions are taught in the U.S. regular utility application Ser. No. 13/410,586 filed on Mar. 2, 2012 now published as US 2013-0229310 A1 on Sep. 5, 2013 and assigned to the assignee of the instant invention. No new matter has been entered.

Briefly, a system for identifying a real-world geographic location of an emission source or device 2 emitting electromagnetic energy includes a platform configured for movement and an apparatus, such as an apparatus 10 or equivalent, disposed on the platform and configured to collect and process, in a passive manner and during movement of the platform, at least a pair of successive samples of the electromagnetic energy emission and define angular and spatial coordinates of the emission source. Such apparatus could be the above described apparatus 10, further executing an additional set of logic algorithms, with the addition of a second antenna 13.

The first antenna, for example such as the above described antenna 12, is mounted on or within the platform and configured to collect a plurality of first samples of the electromagnetic energy emission and the second antenna 13 is positioned in a spaced apart relationship with the first antenna, the second antenna 13 configured to collect a plurality of second samples of the electromagnetic energy emission. There is also a receiver means (including above described elements 14, 16, 18 and 20) mounted on or within the platform and operatively coupled to each of the first and second antennas, 12 and 13 respectively. A processing means 24 is operatively coupled to the receiver means, the processing means 24 operable to process, during movement of the platform, the at least two pair of emission signature samples of the electromagnetic energy emission in accordance with a predetermined logic, the predetermined logic defining the angular and spatial coordinates of the emission source, wherein one sample in each pair is collected at the first antenna 12 and wherein other sample in the each pair is collected at the second antenna 13.

The method of geo-locating an emission source or device 2 includes the step of providing an apparatus 10 including a platform 9 configured for movement, at least a pair of antennas 12 and 13 positioned in a spaced apart relationship with each other, each of the at least pair of antennas 12 and 13 configured to collect the electromagnetic energy emission, wherein at least one of the at least pair of antennas 12 and 13 is mounted on or within the platform 9, a receiver means mounted on or within the platform 9 and operatively coupled to the each of the at least pair of antennas 12 and 13, and a processing means 24 operatively coupled to the receiver means. Then, moving the apparatus 10 toward to or away from the emission source or device 2. Next, collecting, with each of the at least pair of antennas 12 and 13, at least a pair of successive samples of electromagnetic energy emitted by the emission source or device 2. Receiving, at the receiver, the at least pair of successive samples. Finally, defining, with the processing means 24 in accordance to a predetermined logic, angular and spatial coordinates of the emission source or device 2.

BDA functionality of the system benefits from an understanding of the relationship between measured emissions and the source emitting subcomponents to effectively deduce the affected device operation during remote assessment. Instant invention contemplates an emission taxonomy comprised of both RF analysis and near field measurements. The RF analysis was circuit-based analysis of emission signature sources, as identified by the anechoic chamber measurements, in order to develop analytical emission taxonomy for each subsystem. Instant invention further contemplates near-field probing of the devices 2 in order to generate an empirical component of the emission taxonomy for each subsystem. The analytical and empirical components of the analysis are combined to derive an emission taxonomy for comparison to HPM and HEL effects data as well as BDA lab and field measurements.

The instant invention additionally contemplates identifying signal content changes that occur during target device engagement with any directed energy sources, for example such as a high power laser and high powered microwave sources. Sensors and data downlink systems illuminated with a laser fluence characteristic of conditions produced during an engagement with a UAS at range. Monitoring the operation of the targets devices 2 includes recording its real time signal, thermal camera measurements of the target outside temperature, and monitoring changes to the power consumption of the device 2.

Passive RF behavior of the target device 2 is also monitored in the method. Changes to the RF signature are identified and correlated to signal integrity, temperature and power measurements. Data time stamped to determine changes in the RF signature compared with laser turn on time and changes observed on other diagnostics.

The measurement of changes to electromagnetic emission content by the apparatus 10, either passively received or actively induced/illuminated and then received, show damage affects to electronics from an electromagnetic phenomena and/or weapon system. Modifications to passive or actively induced electromagnetic emissions include:

- The existence of additional emissions which are formed, for instance, during the reboot of a device.
- The frequency translation of emission content.
- The degradation of emission content.
- The absence of emission content.

Testing of the apparatus 10 to disable the devices or targets 2 of interest and/or specific sub-components of the devices or targets 2 of interest in simulation of DEW strike achieved acceptable and sufficient results starting at stand-off distances of about 25 m for a baseline test and increasing to stand-off distances of about 75 m and 100 m as testing progresses.

Upon completion of the experiment, recorded data from the experiment was analyzed to verify and supplement sensor indications. The real-time data used within the system provided automated detection as recorded within the sensor portion of the apparatus 10. This data was post-processed to form a more sensitive analysis which leveraged the longer aggregate observation period for reduction to practice of these techniques. An analysis of this data provided an assessment of expected sensor performance improvements when the environment allows for longer analysis periods. Testing and subsequent analysis also indicated that stand-off distances greater than 500 m may be attainable through increased observation periods.

The nature of these tests conducted, which use mission relevant targets, realistic facilities, and live-fire DEW systems from airborne platforms, lends considerable credibility to this invention. For realistic employment, the above described system is required to not only detect and monitor a variety of targets, but demonstrate interoperability and survivability in a harsh mission-relevant environment. Successful demonstration in a mission relevant testing scenario is critical to the successful transition of this technology to DEW programs.

The apparatus 10 was tested over a range of laser fluences, from low fluence where only thermal changes are predicted to complete destruction of the optical sensing or data transmit capabilities of the targets. This range of fluences allows a complete characterization and assessment of changes to the RF spectrum as the target device 2 is compromised.

Electromagnetic signature content changes identified during testing were analyzed against identified laser effects on the target device 2. An analysis of the data performed to determine the feasibility of identifying UAS payload battle damage at range. The instant invention provides the following mission benefits for DEWs:

- An indication of HPM/RF DEW success, collateral damage, and need for additional strikes.
- Simplifies introduction of HPM/RF DEWs into service by mirroring kinetic weapon strike packages.
- Provides pre-mission Intelligence of target type and location based on spectral survey of unintended emissions.

Although the present invention has been shown essentially in terms of assessing battle damage of electric or electronic devices from a weapon strike, it will be apparent to those skilled in the art, that the present invention may be applied to non-military uses, for example in assessing and monitoring equipment and/or facilities for any signs of damage and/or performance degradation or change after a common electromagnetic phenomena such as a lightning strike and/or power surge. It will be well understood, that equipment and/or facilities may lack adequate protection, thus exposing such equipment and/or facilities to electromagnetic phenomena. It will be also well understood that even adequately perceived protection may fail itself during exposure to electromagnetic phenomena and therefore unintentionally expose equipment and/or facilities. The instant invention not only allows determination of the damages or lack of damages to the equipment and/or facilities but also allows determination of any performance modification when the equipment and/or facilities have not been damaged.

The instant invention, method and apparatus, is also advantageous in detecting counterfeit electronic devices 2, for example such as semiconductors, particularly when such semiconductors are installed within higher level assemblies or devices. Again, the advantage of the instant invention is in that the energy is directed onto the semiconductor and/or its surrounding circuitry from a distance, wherein the energy is configured to cause a predetermined result with known or expected electromagnetic emissions 6. For example, the semiconductor in an OFF state may be switched to an ON state to emit a predefined electromagnetic emission pattern or signature.

Additional examples of the applications of the instant invention includes disabling computers or other devices and systems involved in an illegal activity, disabling engine control of a ground or marine vehicle, and the like applications.

Thus, the present invention has been described in such full, clear, concise and exact terms as to enable any person skilled in the art to which it pertains to make and use the same. It will be understood that variations, modifications, equivalents and substitutions for components of the specifically described embodiments of the invention may be made by those skilled in the art without departing from the spirit and scope of the invention as set forth in the appended claims.

We claim:

1. A method comprising the steps of:

(a) directing, from a distance with one of a directed energy weapon, directed energy device and a directed energy event, energy onto one or more devices;

(b) acquiring, with an apparatus receiving and processing intentional or unintentional electromagnetic emissions, an electromagnetic emission from said one or more devices having said energy directed thereonto in step (a); and (c) determining, with said apparatus, based on differences between said electromagnetic emission acquired in step (b) and another electromagnetic emission from said one or more devices, a change of said one or more devices resulting from an application of said directed energy thereonto.

2. The method of claim 1, wherein the step (c) includes the step of comparing, with said apparatus, said electromagnetic emission acquired in step (b) against an electromagnetic emission from said one or more devices acquired prior to said energy directed thereonto.

3. The method of claim 2, wherein the step (c) further includes the step of assessing, with said apparatus, differences between said electromagnetic emission acquired in step (b) and said previously acquired electromagnetic emission.

4. The method of claim 1, wherein step (c) includes the step of determining, with said apparatus, a complete destruction or a degradation of said one or more devices in absence of said electromagnetic emission being acquired in step (b).

5. The method of claim 1, wherein step (c) includes the step of determining, with said apparatus, a destruction or a degradation of a sub-component of said one or more devices or a partial destruction or a partial degradation of said one or more devices in absence of a component of said electromagnetic emission acquired in step (b).

6. The method of claim 1, wherein step (c) includes the step of determining, with said apparatus, a disruption in operation of said one or more devices in presence of at least one difference in said electromagnetic emission acquired in step (b) relative to a previously acquired electromagnetic emission prior to applying energy in step (a).

7. The method of claim 1, wherein the step (a) includes the step of striking said one or more devices with said directed energy weapon.

8. The method of claim 7, wherein the step (a) includes the step of providing at least one of narrowband, wideband and ultra-wideband high powered microwave weapon.

9. The method of claim 7, wherein the step (a) includes the step of providing a high energy laser weapon.

10. The method of claim 7, wherein the step (a) includes the step of providing a kinetic weapon.

11. The method of claim 7, wherein the step (a) includes the step of providing an electromagnetic pulse weapon.

12. The method of claim 7, wherein the step (a) includes the step of providing at least one of missile, artillery ordinance, grenade, bomb and explosive device.

13. The method of claim 1, further comprising the step of identifying, with said apparatus, said one or more devices susceptible to additional directed energy events.

14. The method of claim 1, wherein step (c) includes the step of executing, with said apparatus, at least one measurement.

15. The method of claim 14, further including the step of additional events of directing energy onto said one or more devices and the step of executing said at least one measurement before, after and between said additional events.

16. The method of claim 1, further including the step of determining and/or defining, with said apparatus, classes of said one or more devices and determining and/or defining the number of devices within a specific class.

17. The method of claim 1, further including the step of detecting, with said apparatus, functional state and changes due to directed energy engagements in real-time and the step of collecting and analyzing key spectral slices within the Electro-Magnetic Environment (EME).

18. The method of claim 1, wherein said apparatus comprises an amplifier, a filter disposed between and coupled to said coupled to said antenna and said amplifier, a tuner, an analog to digital converter, and a controller having a processor configured to execute one or more logic algorithms, said filter configured to block energy from the direct energy source from damaging said amplifier.

19. The method of claim 1, further including the step of geo-locating, with said apparatus, said one or more devices emitting electromagnetic energy.

20. The method of claim 19, wherein said step of geo-locating said one or more devices emitting electromagnetic energy includes the steps of:

(a) mounting said apparatus on a platform configured for movement;

(b) operatively coupling said apparatus to at least a pair of antennas positioned in a spaced apart relationship with each other, each of said at least pair of antennas configured to collect the electromagnetic energy emission, wherein at least one of said at least pair of antennas is mounted on or within said platform;

(c) moving said apparatus toward to or away from said one or more devices;

(d) collecting, with each of said at least pair of antennas, at least a pair of successive samples of electromagnetic energy emitted by said one or more devices;

(e) receiving, at said apparatus, said at least pair of successive samples; and (f) defining, with a processor provided within said apparatus, in accordance to a predetermined logic, angular and spatial coordinates of said one or more devices.

21. A method of determining condition of one or more electric or electronic devices after a weapon strike, said method comprising the steps of:

(a) acquiring, with an apparatus receiving and processing intentional or unintentional electromagnetic emissions, a first electromagnetic emission from said one or more devices;

(b) acquiring, with said apparatus, a second electromagnetic emission from said one or more devices having energy applied thereto by said weapon strike; and (c) determining, with said apparatus, differences between said first and second electromagnetic emissions to further determine a state and/or a change in said state of said one or more devices resulting from application of said energy thereonto.

22. The method of claim 21, further comprising the step of providing said apparatus as comprising an amplifier, a filter disposed between and coupled to said antenna and said amplifier, a tuner, an analog to digital converter, and a controller having a processor configured to execute one or more logic algorithms, said filter configured to block energy from damaging said amplifier.

23. The method of claim 22, further comprising the step of installing said apparatus on at least one of an airborne platform, a seaborne platform and a ground borne platform.

24. The method of claim 22, further comprising the step of installing said apparatus on or in at least one of missile, cruise missile, interceptor, aircraft, spacecraft, unmanned aerial vehicle, ground vehicle, stationary ground based facility or platform, a marine vehicle, a submarine, a sea based platform.

25. The method of claim 22, further including the step of using said apparatus to at least acquire one of said first and second electromagnetic emissions.

26. The method of claim 21, further including the step of stimulating and/or illuminating said one or more devices with a source.

27. The method of claim 26, wherein said source is a high powered microwave source.

28. The method of claim 26, wherein said source is a radio-frequency source.

29. The method of claim 26, wherein said source is a high energy laser source.

30. The method of claim 26, further comprising the step positioning said source in a proximity to said apparatus.

31. The method of claim 26, further comprising the step of positioning said source remotely from said apparatus.

32. The method of claim 21, wherein step (d) includes the step of weighting, with said processor, a plurality of algorithms.

33. The method of claim 21, wherein the step (d) further includes the step of identifying, with said apparatus, new electromagnetic emissions that are created after striking, with said weapon, said one or more devices in step (b).

34. An apparatus comprising:

(a) an antenna configured to receive one or more electromagnetic emissions from one or more devices subjected to an application of energy;

(b) an amplifier;

(c) a filter disposed between and coupled to said antenna and said amplifier, said filter configured to block energy emitted by an energy source from damaging said amplifier;

(d) a tuner coupled to said amplifier;

(e) an analog to digital converter (ADC) coupled to said tuner; and (f) a controller coupled to said ADC and having a processor configured to execute one or more logic algorithms to determine differences between a pair of electromagnetic emissions and further determine a change of said one or more devices resulting from the application of the energy thereonto.

35. The apparatus, according to claim 34, wherein said one or more logic algorithms are configured to assess data collected from said electromagnetic emissions received before and/or after an energy directed onto said one or more devices.

36. The apparatus, according to claim 34, wherein said one or more logic algorithms is a plurality of algorithms executed in parallel to each other and wherein each of said plurality of algorithms is configured to assess unique aspect or parameter of said one or more devices.

37. The apparatus of claim 34, wherein said apparatus is installed on or in at least one of missile, cruise missile, interceptor, aircraft, spacecraft, unmanned aerial vehicle, ground vehicle, stationary ground based facility or platform, a marine vehicle, a submarine, a sea based platform.

38. The apparatus of claim 34, wherein said apparatus is configured to monitor and/or assess at least one of state, change in state and operating condition of electrical or electronic manufacturing equipment having energy directed thereonto.

39. The apparatus of claim 34, further comprising an energy source.

40. The apparatus of claim 34, wherein said apparatus is configured to monitor and/or assess, after a directed energy event, at least one of state, change in state and operating condition of components of said one or more devices being incorporated into a manufactured product.

41. The apparatus of claim 34, wherein said apparatus is configured to provide a battle damage assessment of at least one of narrowband, wideband and ultra-wideband High Power Microwave (HPM) weapons.

42. The apparatus of claim 34, wherein said apparatus is configured to provide a battle damage assessment of High Energy Laser Weapons.

43. The apparatus of claim 34, wherein said apparatus is configured to monitor and/or assess at least one of state, change in state and operating condition of a power plant for damage by an electromagnetic phenomena, wherein said electromagnetic phenomena is selected form a group consisting of lightning strikes, cosmic ray events, and solar flares.

44. The apparatus of claim 34, wherein said apparatus is configured to monitor and/or assess at least one of state, change in state and operating condition of manufactured and/or manufacturing equipment for damage by an electromagnetic phenomena, wherein said electromagnetic phenomena is selected from a group consisting of lightning strikes, cosmic ray events, and solar flares.

45. The apparatus of claim 34, wherein said apparatus is configured to monitor and/or assess at least one of state, change in state and operating condition of electronic and/or electrical devices for damage by an electromagnetic phenomena, wherein said electromagnetic phenomena is selected from a group consisting of lightning strikes, cosmic ray events, and solar flares.

46. The apparatus of claim 34, wherein said apparatus is configured to monitor and/or assess at least one of state, change in state and operating condition of at least one of electronic devices, electrical devices, manufactured equipment, manufacturing equipment and facilities for damage by power surges.

47. The apparatus of claim 34, wherein said apparatus is configured to detect counterfeit semiconductors.

48. The apparatus of claim 34, wherein said apparatus is configured to detect a change, a degradation, a nominal status, a non-operational status, a damage or a detected status of the one more devices subjected to the application of energy.

49. A method comprising the steps of:

(a) acquiring, with an apparatus comprising an amplifier, a filter disposed between and coupled to an antenna and said amplifier, a tuner coupled to said amplifier, an analog to digital converter (ADC) coupled to said tuner, and a controller coupled to said ADC and comprising a processor, an electromagnetic emission from one or more devices having energy applied thereto by a weapon strike; and (b) determining, with said apparatus, based on differences between said electromagnetic emission acquired in step (b) and another electromagnetic emission from said one or more devices, a state and/or a change in said state of said one or more devices resulting from application of said energy thereonto.

50. The method of claim 49, wherein said electromagnetic phenomena includes at least one of lightning strike, cosmic ray event, and solar flare.

51. The method of claim 50, further including the step of monitoring a power plant for damage or change in operation and/or state from said electromagnetic phenomena.

52. The method of claim 50, further including the step of monitoring manufactured and/or manufacturing equipment for damage or change in operation and/or state from said electromagnetic phenomena.

53. The method of claim 49, wherein said step (a) includes the step of exposing, intentionally or unintentionally, said one or more devices to power surges.

54. A method comprising the steps of:

(a) acquiring, with an apparatus receiving and processing intentional or unintentional electromagnetic emissions, an electromagnetic emission from one or more electric devices having said energy applied thereonto by an electromagnetic phenomena and/or a power surge; and (b) determining, with said apparatus, based on differences between said electromagnetic emission acquired in step (b) and another electromagnetic emission from said one or more electric devices, a state and/or a change in said state of said one or more device resulting from said application of said energy thereto.

* * * * *